US005518129A

United States Patent [19]

Sieberer

[11] Patent Number: 5,518,129

[45] Date of Patent: May 21, 1996

[54] BOOM INCLUDING PLURAL ARMS TELESCOPICALLY EXTENDIBLE AND RETRACTABLE SUCCESSIVELY

[75] Inventor: Franz Sieberer, Weissenkirchen, Austria

[73] Assignee: Palfinger Aktiengesellschaft, Salzburg/Bergheim, Austria

[21] Appl. No.: 70,358

[22] PCT Filed: Oct. 21, 1992

[86] PCT No.: PCT/AT92/00128

§ 371 Date: Jun. 4, 1993

§ 102(e) Date: Jun. 4, 1993

[87] PCT Pub. No.: WO93/08116

PCT Pub. Date: Apr. 29, 1993

[30] Foreign Application Priority Data

Oct. 21, 1991 [AT] Austria ..... 2091/91

[51] Int. Cl.[6] ..... B66C 23/06

[52] U.S. Cl. ..... 212/349; 212/230

[58] Field of Search ..... 212/268, 162, 212/163, 230, 349

[56] References Cited

U.S. PATENT DOCUMENTS

| | | | |
|---|---|---|---|
| 3,657,969 | 4/1972 | Wirkus | 212/268 |
| 3,658,189 | 4/1972 | Brown et al. . | |
| 3,809,248 | 5/1974 | Ohniwa et al. . | |
| 3,841,494 | 10/1974 | Chalupsky et al. . | |
| 4,125,974 | 11/1978 | Kay et al. . | |
| 4,490,951 | 1/1985 | Mentzer et al. | 212/268 |

FOREIGN PATENT DOCUMENTS

| | | | |
|---|---|---|---|
| 1756055 | 4/1970 | Germany . | |
| 2310550 | 3/1973 | Germany | 212/268 |
| 2702650 | 8/1977 | Germany . | |
| 2648608 | 11/1979 | Germany . | |
| 3413443 | 10/1985 | Germany . | |

*Primary Examiner*—David A. Bucci
*Assistant Examiner*—Thomas J. Brahan
*Attorney, Agent, or Firm*—Wenderoth, Lind & Ponack

[57] ABSTRACT

A loading crane that can be mounted on a lorry has a jib composed of several arms telescopically nested into each other. A hydraulic unit composed of piston and cylinder is arranged between successive arms. When an arm is extended, a stop arranged on the previous arm actuates a valve entrained with the extended arm, which opens a hydraulic supply for the arm that follows the extended arm. Such valve is arranged at the closed end of a hydraulic cylinder of the arm that follows the extended arm.

10 Claims, 4 Drawing Sheets

BOOM INCLUDING PLURAL ARMS TELESCOPICALLY EXTENDIBLE AND RETRACTABLE SUCCESSIVELY

BACKGROUND OF THE INVENTION

The invention relates to a loading crane that can be attached to a truck and that has a boom including several telescopic arms, wherein one hydraulic unit, comprising piston and cylinder, it arranged between each pair of successive arms. Upon telescoping an arm, a stop attached to the preceding arm actuates a valve which is moved along with the telescoped arm and which releases the hydraulic supply for the subsequent arm.

Sequence controls for loading cranes have the purpose of ensuring that the individual arms of a telescopic boom are telescoped or retracted in a specific, usually fixed order of sequence. This is achieved either by means of an electro-hydraulic controller (DE-PS 26 48 608) or by avoiding electric components with significant mechanical complexity (DE-OS 34 13 443). Correspondingly, the loading cranes used in the past by the Palfinger Aktiengesellschaft company are equipped with a mechanically simple sequence control of the type defined above and which has, however, the drawback that only that arm of the telescopic boom that is braced directly against the folding arm enveloping the preceding arm is automatically telescoped first. The other parts of the telescopic boom are, in contrast, not fixed with respect to the order of sequence at which they are telescoped.

In the case of the cranes, in prior public use, of the Palfinger Aktiengesellschaft, the valve which is actuated by means of the stop attached to the folding arm is on the piston-sided end of the hydraulic cylinder that actuates the first arm, such end being directed toward the folding arm. Not until this first arm is totally telescoped does the valve designed as a non-return valve release the throughflow of hydraulic fluid to the cylinders of the other telescopic arms.

SUMMARY OF THE INVENTION

The object of the invention is to provide a device of the type described above in such a manner that it can be used to control the sequence of several telescopic arms. Therefore, merely the multiple use of the device in prior public use would not be a suitable solution for this problem, because the lines leading from the stop-actuated valve to the hydraulic unit supplied by such valve, in addition to the plurality of hydraulic units, valves and stops, no longer can be housed on the outside of the folding arm. The invention makes these pipelines superfluous by arranging the valve, which upon telescoping an arm releases the oil supply to the following arm, not on the telescoped arm but rather on the following arm. Thus, it is provided according to the invention that the valve is disposed on the closed end of the hydraulic cylinder of the arm following the telescoped arm.

The invention makes it possible not only to avoid disturbing pipelines, but also primarily a very compact construction of the valves that are integrated virtually in the floor of the hydraulic unit. As will be explained in detail below, it correspondingly is provided in an advantageous manner that the valve is a spring-loaded slide valve which is flanged directly to the cylinder and whose slide rod interacts with the stop.

According to the prior art, the stop-controlled valve is a simple non-return valve. Thus, it can be achieved that the first telescopic arm is necessarily telescoped first, but not retracted last. To ensure that the first telescopic arm retracts last, it is well known to provide the piston of the suitable hydraulic unit with a mandrel which actuates a non-return valve attached to the floor of the hydraulic unit when the piston is totally driven in. The invention makes it possible to combine the two measures and thus to arrive as a simple sequence control to telescope and retract even several telescopic arms in that the valve is a shutoff valve, to which a non-return valve is connected in parallel that is opened in the well known manner when the piston is totally pushed in.

BRIEF DESCRIPTION OF THE DRAWINGS

Details of the invention are explained in the following with reference to the accompanying drawings, wherein.

DETAILED DESCRIPTION OF THE INVENTION

Figure 1:
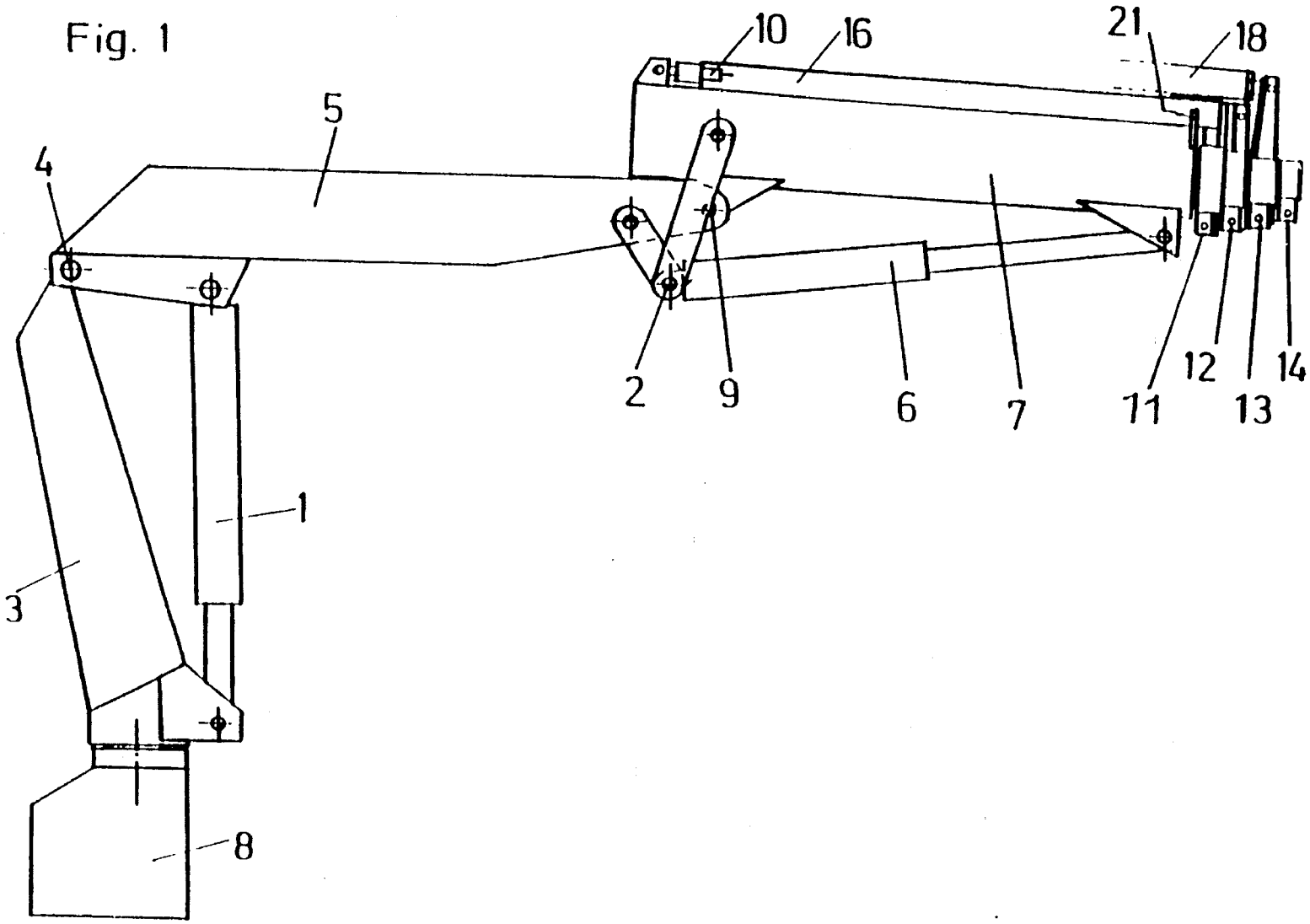
FIG. 1 is a diagrammatic view of a conventional loading crane.

A loading crane according to the state of the art shown in FIG. 1 includes a stand 3, which can be rotated around a vertical axis on a base 8. A lifting arm 5 is swivelled around a horizontal axis 4 relative to stand 3 by means of a lifting cylinder 1. A so-called folding arm 7 is swivelled around another horizontal axis 9 with the aid of a hydraulic unit 6 of a toggle lever 2. The folding arm 7 includes a series of telescopic arms 11–14, which altogether can be called a thrust arm or boom.

The invention relates to a sequence control to telescope and retract arms 11, 12, 13, 14, which are connected to the folding arm 7 or to each other by means of a series of hydraulic units 16, 17, 18, 19 (in part not visible). In the design of a crane in prior public use as shown in FIG. 1, only the telescoping of the arm 11 before that of arms 12–14 is ensured. To this end, the open side of the cylinder of the hydraulic unit 16, which connects the folding arm 7 to the telescopable arm 11, has a valve 10. Such valve does not release the supply of pressurized fluid to the hydraulic unit 17, which is not visible in the drawing and which connects the arms 1 and 12, until it strikes a stop 21 connected to the folding arm 7.

According to the invention, the valve 10 is not connected, as shown in FIG. 1, to the cylinder of the hydraulic unit 16 which serves to telescope the arm 11 out of the folding arm 7. Rather, the stop 21 at the folding arm 7 projects, according to the invention, into the path of a valve 32 which is attached to the closed end of the cylinder of the hydraulic unit 17. In an analogous manner, a valve 32' which is connected to the hydraulic unit 18 in order to telescope the arm 13 strikes against a stop 22 connected firmly to the arm 11 by means of the hydraulic unit 17 when the arm 12 is telescoped. Stop 22 can project, for example, sideways from a floor of the cylinder of the hydraulic unit 16. A stop 23 actuating valve 32" of the hydraulic unit 19 serving to telescope the arm 14 is located in an analogous manner on a part that is firmly connected to the arm 12, for example, on the open end of the cylinder of the hydraulic unit 17.

Figure 2:
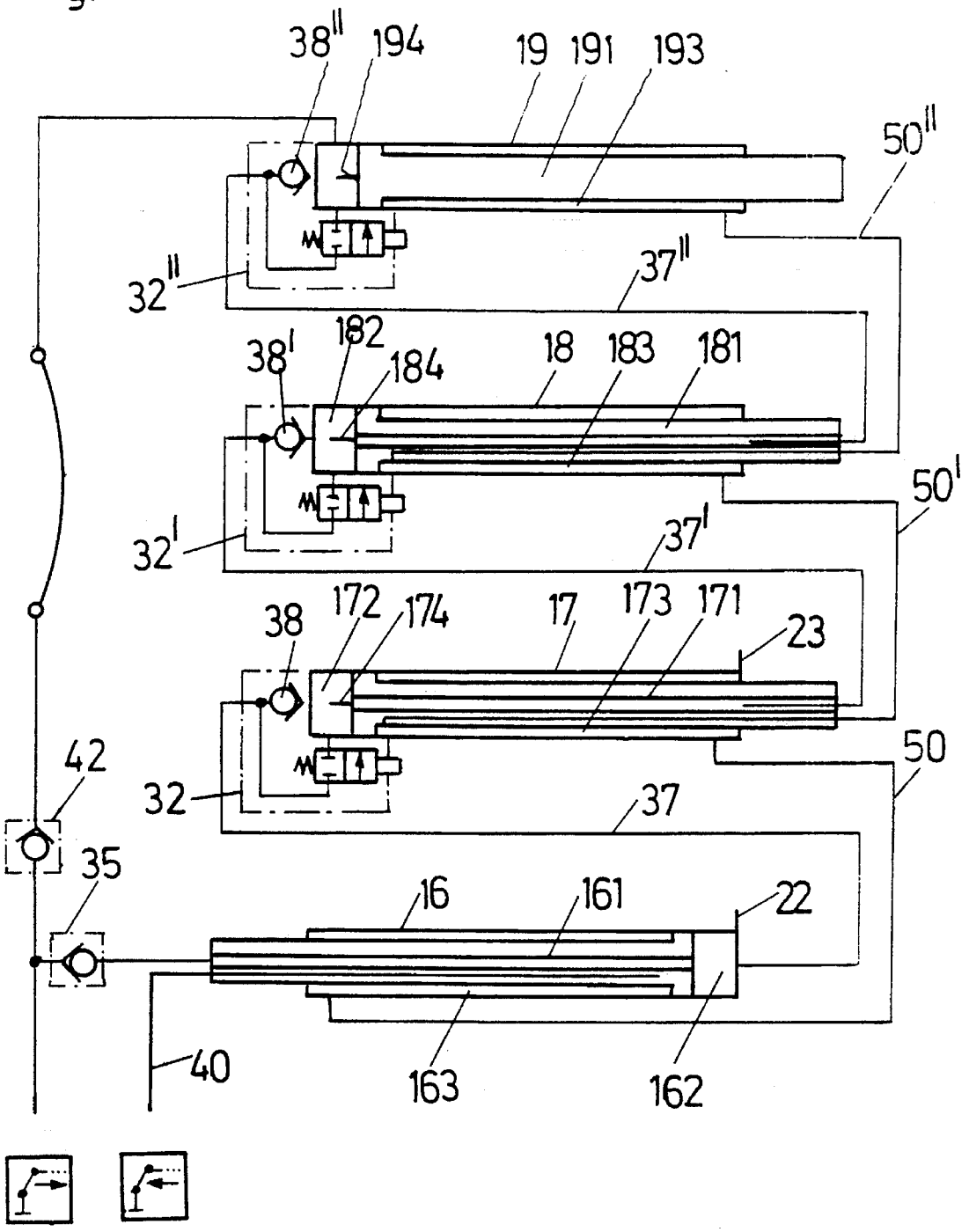
FIG. 2 is a circuit diagram of a sequence control according to the invention.

FIG. 2 shows the function of a device constructed in the above described manner. When the boom is extended, hydraulic fluid flows by way of a non-return valve 35 through a hollow piston rod 161 of the hydraulic unit 16 into a cylinder chamber 162. In this manner the cylinder of the hydraulic unit 16 is pushed out to the right, since the hydraulic fluid cannot flow out through a line 37 as long as valves 32 and 38 are closed. Not until the hydraulic unit 16 has totally telescoped the arm 11 so that the vale 32 pushes against the stop 21 at the folding arm 7 and thus has been opened, does the hydraulic fluid flow into the cylinder chamber 172 of the hydraulic unit 17, resulting in the arm 12 being telescoped. In an analogous manner the arms 13 and 14 are telescoped after the arm 12.

Upon retracting the described telescopic arm, the hydraulic fluid is led by way of a line 40 into a space 163 enveloping the piston rod 161 of the hydraulic unit 16. Yet this does not accomplish anything until the hydraulic fluid has flowed through line segments 50, 50', 50" in succession into spaces 173, 183, 193 enveloping the piston rods of the hydraulic units 17, 18, 19 and has displaced the piston rod 191 to the left, a process that is possible if the non-return valve 42 is opened. If the piston rod 191 and the arm 14 connected thereto are totally retracted, a mandrel 194 opens at the bottom of the piston rod 191 a valve 38" and thus bridges the valve 32", so that at this stage hydraulic fluid can flow out of the cylinder chamber 182 of the hydraulic unit 18. Subsequently a mandrel 184 opens at the end of piston 181 a valve 38', where the described process repeats itself in an analogous manner.

Figure 3:
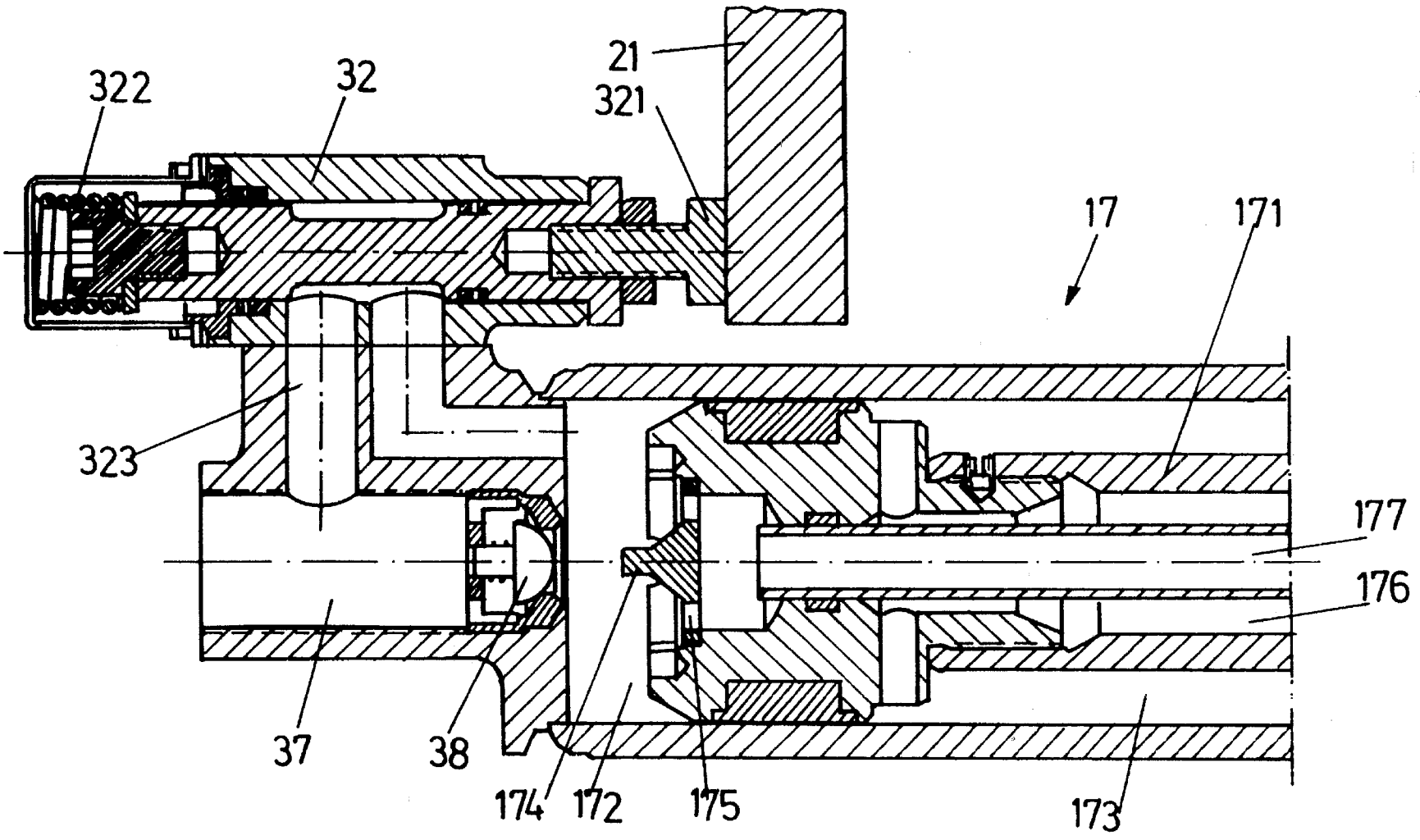
FIGS. 3 and 4 are longitudinal views of an end region of one hydraulic unit according to the invention, with a valve thereof opened and closed, respectively.
Figure 4:
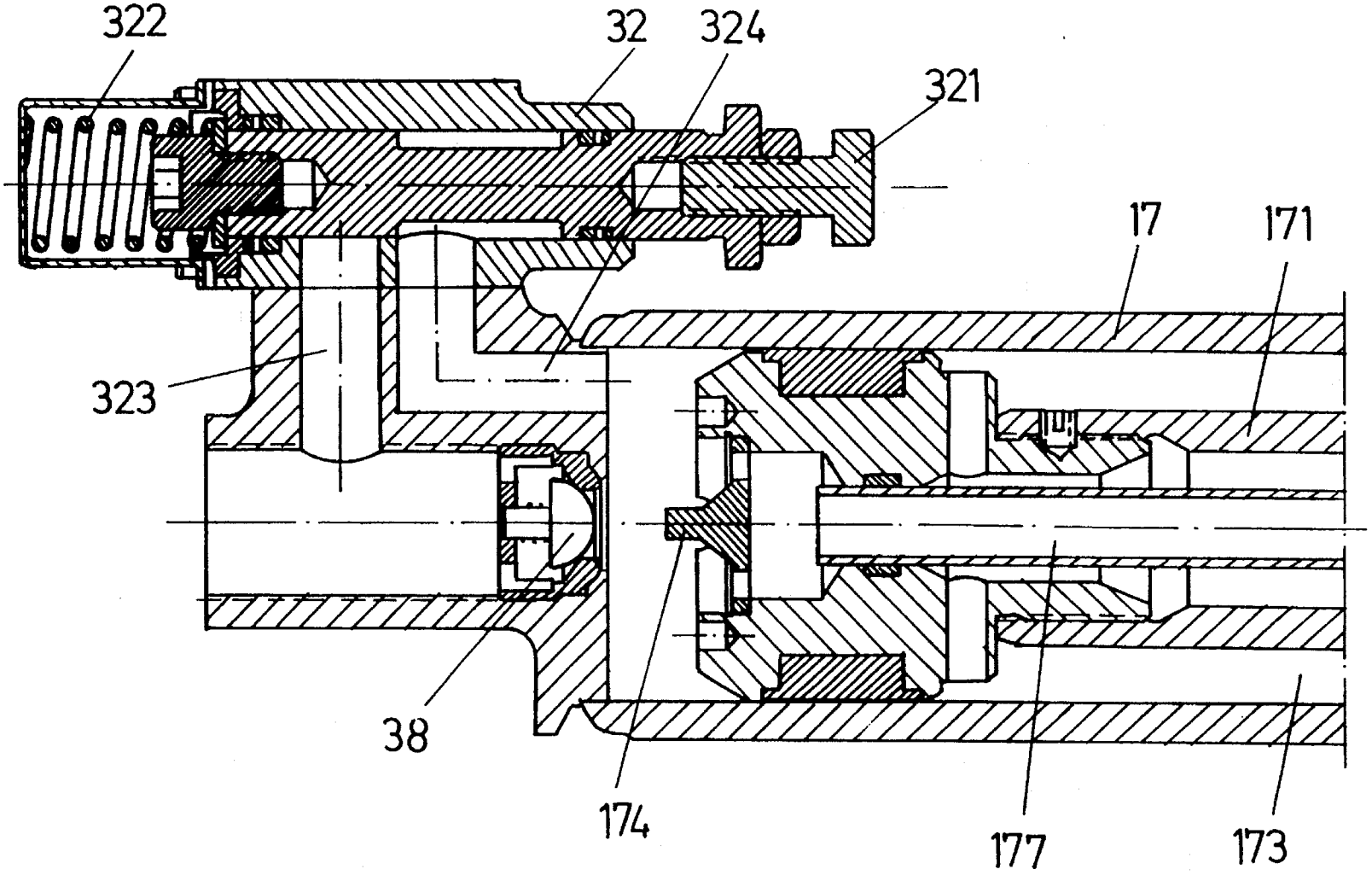

FIGS. 3 and 4 show an embodiment for the construction of a slide valve 32 arranged according to the invention. In the open position of the valve shown in FIG. 3, a slide rod 321 is pushed against the action of a spring 322 through the stop 21 attached to the folding arm 7. The hydraulic fluid supplied by way of the line 37 flows unimpeded into the cylinder chamber 172. The fluid can continue to flow through a pipe 177, arranged in the interior of the piston, through openings 175 only if the valve 32' is also open. This, however, assumes that the piston 171 is moved out of the illustrated position completely to the right. The line 50 shown in FIG. 2 opens on the right end of the hydraulic unit 17 into space 176 enveloping the line 177 in the piston 171 and passes from there into the space 173 enveloping the piston 171. In the position shown in FIG. 4, the valve 32 closes flow through bores 323 and 324. In this case, the hydraulic fluid can flow through the pipe 177 only if mandrel 174 has opened the non-return valve 38 when the piston 171 is thus in its outermost left position.

I claim:

1. A boom comprising:

a plurality of arms arranged to be successively extendible and retractable and including at least a first arm, a second arm extendible from said first arm, and a third arm movable with said second arm and then, when said second arm has been fully extended from said first arm, extendible from said second arm;

plural hydraulic units including at least a first hydraulic unit for moving said second arm relative to said first arm and a second hydraulic unit for moving said third arm relative to said second arm, each said hydraulic unit comprising a cylinder and a piston;

a valve, mounted on said second hydraulic unit and movable with said second arm during movement thereof relative to said first arm, for controlling hydraulic supply to said second hydraulic unit; and a stop mounted on said first arm at a position to actuate said valve upon said second arm being fully extended from said first arm to thereby control hydraulic supply to said second hydraulic unit to extend said third arm relative to said second arm.

2. A boom as claimed in claim 1, wherein said valve comprises a shutoff valve.

3. A boom as claimed in claim 2, further comprising a non-return valve in said second hydraulic unit and connected hydraulically in parallel to said shutoff valve.

4. A boom as claimed in claim 3, wherein said non-return valve is opened by movement of said piston of said second hydraulic unit relative to said cylinder thereof.

5. A boom as claimed in claim 2, wherein said shutoff valve includes a valve housing mounted on said cylinder of said second hydraulic unit, a valve slide slidably mounted in said valve housing, and a spring biasing said valve slide to a closed position preventing hydraulic supply to said second hydraulic unit to extend said third arm.

6. A boom control system for controlling successive extension and retraction of a plurality of arms of a boom including at least a first arm, a second arm extendible from the first arm, and a third arm movable with the second arm and then, when the second arm has been fully extended from the first arm, extendible from the second arm, said control system comprising:

plural hydraulic units including at least a first hydraulic unit for moving the second arm relative to the first arm and a second hydraulic unit for moving the third arm relative to the second arm, each said hydraulic unit comprising a cylinder and a piston;

a valve, mounted on said second hydraulic unit to be movable with the second arm during movement thereof relative to the first arm, for controlling hydraulic supply to said second hydraulic unit; and a stop to be mounted on the first arm at a position to actuate said valve upon the second arm being fully extended from the first arm to thereby control hydraulic supply to said second hydraulic unit to extend the third arm relative to the second arm.

7. A system as claimed in claim 6, wherein said valve comprises a shutoff valve.

8. A system as claimed in claim 7, further comprising a non-return valve in said second hydraulic unit and connected hydraulically in parallel to said shutoff valve.

9. A system as claimed in claim 8, wherein said non-return valve is opened by movement of said piston of said second hydraulic unit relative to said cylinder thereof.

10. A system as claimed in claim 7, wherein said shutoff valve includes a valve housing mounted on said cylinder of said second hydraulic unit, a valve slide slidably mounted in said valve housing, and a spring biasing said valve slide to a closed position preventing hydraulic supply to said second hydraulic unit to extend the third arm.

* * * * *